United States Patent [19]

Bloomer et al.

[11] Patent Number: 4,721,033

[45] Date of Patent: Jan. 26, 1988

[54] METHOD AND APPARATUS FOR REMOVING SPRAYED MATERIAL FROM THE AIR EXHAUSTED FROM A SPRAY BOOTH

[75] Inventors: Ivan Bloomer, London; Ian H. Lynham, Stratford-upon-Avon, both of England

[73] Assignee: Haden Drysys International Limited, London, England

[21] Appl. No.: 893,300

[22] PCT Filed: Sep. 30, 1985

[86] PCT No.: PCT/GB85/00445

§ 371 Date: May 30, 1986

§ 102(e) Date: May 30, 1986

[87] PCT Pub. No.: WO86/02022

PCT Pub. Date: Apr. 10, 1986

[30] Foreign Application Priority Data

Oct. 1, 1984 [GB] United Kingdom ..... 8424678

[51] Int. Cl.[4] ..... B05B 15/12

[52] U.S. Cl. ..... 98/115.2; 118/326; 118/634; 118/DIG. 7

[58] Field of Search ..... 98/115.2; 118/326, DIG. 7, 118/634

[56] References Cited

U.S. PATENT DOCUMENTS

| | | | |
|---|---|---|---|
| 3,138,087 | 6/1964 | Larsson et al. | 98/115.2 |
| 4,220,078 | 9/1980 | Walker et al. | 98/115.2 |
| 4,285,270 | 8/1981 | Donahue | 98/115.2 |
| 4,425,870 | 1/1984 | Marshke | 98/115.2 X |
| 4,440,554 | 4/1984 | Perry | 98/115.2 |
| 4,515,073 | 5/1985 | Dorsch et al. | 98/115.2 |
| 4,537,120 | 8/1985 | Josefsson | 98/115.2 |

FOREIGN PATENT DOCUMENTS

| | | |
|---|---|---|
| 1165022 | 6/1967 | United Kingdom . |
| 1399805 | 7/1975 | United Kingdom . |
| 1540723 | 2/1979 | United Kingdom . |
| 2007542B | 4/1982 | United Kingdom . |

*Primary Examiner*—William E. Wayner
*Assistant Examiner*—Steven E. Warner
*Attorney, Agent, or Firm*—Niro, Scavone, Haller & Niro, Ltd.

[57] ABSTRACT

A method and apparatus for removing sprayed material from the air exhausted from a spray booth comprising an enclosure in which the material is sprayed. Air supply means are arranged to supply air to the enclosure, and outlet fans are provided for extracting air laden with the sprayed material from the enclosure. Two physically separate air outlet paths are provided for the extracted air and respective washing means for removing the sprayed material from the laden air are associated with each said path. The washing means are arranged to bring the material laden air into intimate contact with a cleaning liquid. Means are provided for controlling the volume of air flowing through each outlet path such that the volume flowing along each outlet path can be varied in dependence upon the volume of air exhausted from the spray booth. This enables the efficiency of the respective washing means to be maintained.

9 Claims, 2 Drawing Figures

METHOD AND APPARATUS FOR REMOVING SPRAYED MATERIAL FROM THE AIR EXHAUSTED FROM A SPRAY BOOTH

The present invention relates to spray booths, and in particular to a method and apparatus for removing paint or other sprayed material from the air exhausted from a spray booth.

It is customary to extract air from a paint spray booth and to wash it with a cleaning liquid, generally water, to remove the paint entrained in the exhaust air. Examples of washing systems for the exhaust air from paint spray booths are described in British Patent specifications Nos. 1165022, 1399805, and 2007542B.

The washing systems described in the above identified patent specifications generally exhibit their best efficiency if a substantially constant volume of air flows therethrough. If the volume of air or the air speed varies, the characteristic performance of the washing systems varies. This can present a problem in that it may be required to vary the volume of air flowing through the paint spray booth. Clearly if the air flow is so varied the efficiency of the washing systems can be impaired.

In some applications the volume of air flow through the booth must be reduced, and in other applications the volume of air flow can be substantially reduced without adversely affecting the painting operation. As the air supplied to the booth is generally conditioned to be at a predetermined temperature and humidity, any such reduction in the volumes used represents a substantial energy saving.

Thus, when human operators are working in a spray booth, the downward air speed is normally required to be at least 0.5 m/sec. This air speed is not required for the painting operation itself, and if automatic applicators are used, the air velocity can be reduced to 0.3 m/sec or even less.

The present invention seeks to provide a spray booth through which the air flow rates can be varied without impairing the efficiency of the washing systems.

According to the present invention there is provided a spray booth comprising an enclosure in which material is sprayed, an air inlet path in communication with said enclosure, means for extracting air laden with the sprayed material from said enclosure, and apparatus for removing the sprayed material from the material laden extracted air, said apparatus comprising washing means through which said material laden air is arranged to flow in intimate contact with a cleaning liquid, characterized in that at least two physically separate air outlet paths for said extracted air are provided, in that respective apparatus for removing sprayed material is associated with each said air outlet path, and in that means are provided for controlling the volume of air flowing through each said outlet path.

In an embodiment, a substantially horizontally extending sub-floor is arranged at the base of the enclosure to define an air outlet chamber in communication with the enclosure, and one or more substantially vertically extending partitions are arranged to divide said air outlet chamber into two or more separate chambers each constituting a respective air outlet path.

Preferably, each said washing means comprises one or more tubular members extending substantially vertically within the respective separate chamber and passing through said sub-floor. Means for supplying cleaning liquid are arranged to supply the cleaning liquid onto said sub-floor such that the cleaning liquid passes through the tubular members in intimate contact with said material laden air. The tubular members may project relative to the sub-floor such that a pond for the cleaning liquid is defined on the upper surface of the sub-floor.

In one embodiment, said substantially vertically extending partitions project relative to the sub-floor and thereby divide the upper surface thereof into sections, each section being associated with a respective separate chamber. Separate cleaning liquid supply means may then be provided for each section of the sub-floor.

The tubular members extending through the sub-floor may be circular, rectangular or any other shape in cross section, and these members may be of any size.

The sub-floor is preferably spaced above a floor or plate and the tubular members are arranged such that the air and liquid flowing through the members impacts the floor or plate.

In an embodiment, a respective air exhaust fan is associated with each of said separate chambers and is arranged to discharge exhaust air into one or more outlet ducts and/or to atmosphere. Control means, such as dampers, are associated with each said exhaust fan.

In an alternative embodiment, a common exhaust fan is provided and is communicated with each said separate chamber by way of a respective connecting duct. The common exhaust fan is arranged to discharge exhaust air into one or more outlet ducts and/or to atmosphere. Control means, such as dampers, are associated with each said connecting duct.

Preferably, the spray booth further comprises air supply means for supplying air to said air inlet path. For example, said air supply means may comprise an air supply fan and a control damper arranged to control the volume of air supplied by said air supply fan.

The invention also extends to a method for removing material from material laden air exhausted from a spray booth, the method comprising the steps of flowing the material laden air through washing means, simultaneously flowing cleaning liquid through said washing means, and arranging that said material laden air and said cleaning liquid come into intimate contact such that said material is washed out of the air by said cleaning liquid, characterized in that the washing means are arranged in two or more physically separate air outlet paths, and in that the method further comprises the steps of adjusting the volume of air flowing along each air outlet path in dependence upon the volume of air exhausted from the spray booth.

In an embodiment, the number of air outlet paths along which air flows is varied in dependence upon the volume of air exhausted from the spray booth. For example, to decrease the volume of air exhausted from the booth, one or more of the air outlet paths are closed to air flow. This enables the volume of air flowing through the air outlet paths which remain open to be kept substantially constant.

BRIEF DESCRIPTION OF THE DRAWINGS

An embodiment of the present invention wil hereinafter be described, by way of example, with reference to the accompanying drawings, in which.

Figure 1:
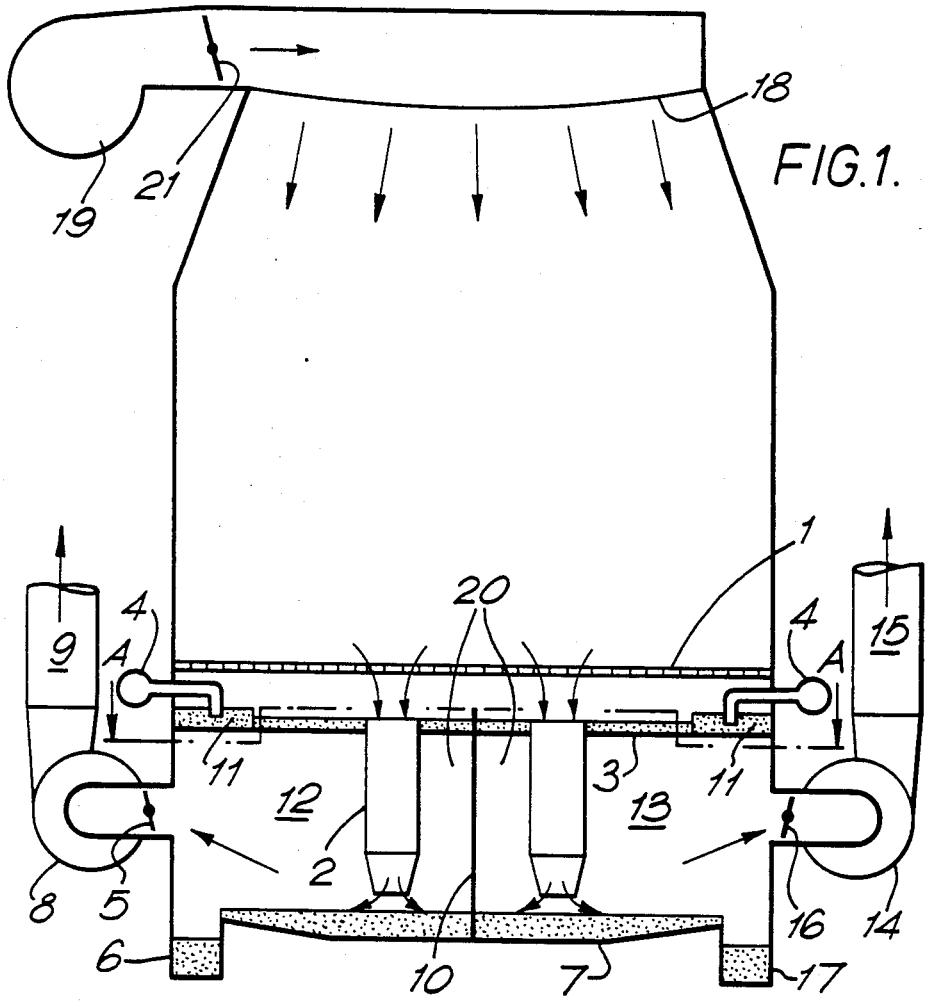
FIG. 1 shows a section through a paint spray booth incorporating an embodiment of the invention.
Figure 2:
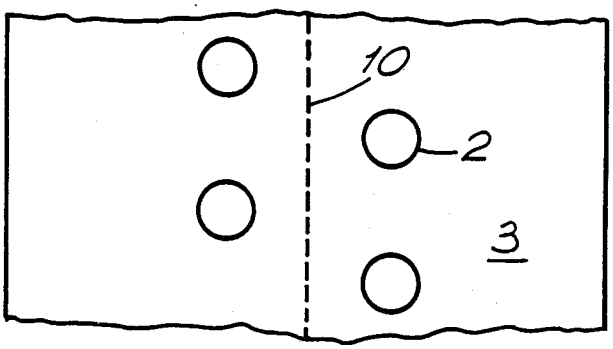
FIG. 2 shows a plan of the spray booth taken along the line A—A of FIG. 1.

The paint spray booth illustrated in the drawings is of the type through which automobile bodies or other articles to be painted are moved by way of conveyor means (not shown). The articles are painted, either automatically or manually, by spray painting means.

It is customary to extract air from the paint spray booth and to wash it with a cleaning liquid, in order to remove paint entrained in the exhaust air. A supply of air is fed to a spray booth through a distributor. Before it is fed to the booth, this supply air may be conditioned by means of air conditioning means (not shown) such that it has a predetermined temperature, humidity and cleanliness.

In the embodiment illustrated in FIG. 1, the supply of air is fed to the spray booth through a distributor 18 by way of a supply fan 19. The volume of air supplied by the fan 19 can be controlled by a control damper 21. The air supplied to the booth passes over the articles to be spray painted where it becomes laden with paint. The paint laden air passes through floor grilles 1 and then through two or more substantially vertically extending exhaust tubes 2 provided in a substantially horizontal sub-floor 3 which extends across the booth beneath the grilles 1. A cleaning liquid, generally water which has been chemically treated to assist the adherence of paint particles to the water droplets, is fed to the sub-floor 3 by way of pumps (not shown), pipes 4, and troughs 11. Each exhaust tube 2 is arranged to project above the level of the sub-floor 3 such that the sub-floor becomes flooded. The cleaning liquid is continuously supplied to the troughs 11, and hence to the sub-floor 3, and thus the liquid flows over the upper open end of each exhaust tube 2 and through the tube 2 in intimate contact with the air flowing therethrough. This washes paint from the air.

Each exhaust tube 2, which may be circular, rectangular, or any other shape in cross section, communicates the upper side of the sub-floor 3 with a respective one of two physically separate chambers 12 and 13. In this respect, the sub-floor 3 defines an outlet chamber 20 beneath the paint spraying enclosure and this outlet chamber 20 is divided into the two chambers 12 and 13 by way of a vertically extending partition 10. In the embodiment illustrated the partition 10 extends above the level of the sub-floor 3 to divide the upper surface of this floor into sections. However, if preferred, the partition 10 can be terminated at the sub-floor 3.

In the embodiment illustrated each chamber 12 and 13 houses a plurality of exhaust tubes 2. Of course, where the spray booth is restricted in length only a single exhaust tube might be contained in each of the chambers.

The air-liquid mixture leaving each of the exhaust tubes 2 is arranged to impact a base plate 7 such that the turbulence induced by this impact assists in the washing process. This base plate 7 defines the lower extent of the air outlet chamber 20 and the partition 10 is supported thereby.

The chamber 12 is communicated to atmosphere by way of an exhaust fan 8 and an outlet duct 9. Similarly, the chamber 13 is communicated to atmosphere by way of an exhaust fan 14 and an outlet duct 15. Thus, air leaving the exhaust tubes 2 passes into the respective chamber 12 or 13 and is then exhausted to atmosphere by way of the respective exhaust fan 8, 14 and outlet duct 9, 15.

The cleaning liquid in which the paint is now entrained passes into a respective flume 6, 17 and thence to a reservoir (not shown). The paint can be removed from the cleaning liquid by any suitable means and, if required, the liquid can then be recirculated by way of the pumps (not shown) and the pipes 4 to the sub-floor 3. One apparatus for removing paint solids from a cleaning liquid is described in British Patent specification No. 1540723.

It will be seen that each exhaust fan 8, 14 has an associated control damper 5, 16 operable to control the volume of air extracted by the exhaust fan. Thus, the dampers 5 and 16 can be used to adjust the volume of air flowing through the respective chambers 12 and 13.

Consider the volume of air flowing through the spray booth when human operators are working therein to be 100%. The volume of air required when no humans are present and spraying is by automatic means will be less than this, say 60%. In these circumstances, for manual operation by humans, the dampers 5 and 16 and their corresponding exhaust fans 8 and 14, would be adJusted such that 60% of the total air flow is drawn through one of the chambers, say chamber 12, whilst the other 40% of the air flow is exhausted through the second chamber 13.

When it is then required to change the spray booth over to automatic operation, damper 16 is closed and fan 14 is stopped to shut off the extract of air through the chamber 13, and the damper 21 is adjusted to reduce the volume of the air supplied to 60%. The exhaust fan 8 will continue to extract substantially the same volume of air, namely the 60% volume. Thus, the air flow through the spray booth will drop from 100% to 60% but the volume of air flowing through the exhaust tubes 2 in the chamber 12 will remain substantially constant. Accordingly, the efficiency of the washing system in the charber 12 will be maintained even though the air flow has substantially decreased.

The water flow to and from each section of the sub-floor 3 will remain the same, flowing into the tubes 2 by way of the pipes 4 and the troughs 11 and returning to the reservoir (not shown) by way of the flumes 6 and 17.

Clearly, the volume flow of air can be reduced to 40% of the original value by closing the damper 5 and stopping the exhaust fan 8 to close off the chamber 12 whilst using the chamber 13 to extract air from the paint spray booth. Again, in this situation, the volume of air flowing through the exhaust tubes 2 within the chamber 13 will remain substantially constant such that their efficiency will not be adversely effected.

Generally, it is sufficient to divide the outlet chamber 20 into two or more physically separate chambers each providing an outlet path for a predetermined percentage of the total air flow possible through the spray booth. Extract of air through a selected one of these chambers is then prevented when it is required to reduce the air flow through the booth. Of course, if finer adjustment of the air flow rates is required, further control means such as static pressure regulators (not shown) can be provided to enable the volume of air flowing through one or both of the separate chambers to be further adjusted, for example by operation of the associated damper 5 or 16.

Of course, more than two physically separate chambers could be provided, each being arranged to extract a predetermined percentage of the total air flow. As the number of chambers is increased, so is the flexibility of the system increased as it can provide greater variations in the air flow rates. Of course, this increased flexibility has to be paid for by increased complexity and cost of the apparatus.

In the embodiment illustrated, the two chambers 12 and 13 are separated by a partition 10 which extends substantially along the longitudinal axis of the spray booth. The exhaust tubes 2 are arranged on either side of this partition 10.

However, spray booths are known in which exhaust tubes 2 are aligned along the longitudinal axis of the booth. In this case, a staggered partition (not shown) could be provided and arranged to pass between adjacent exhaust tubes and along opposite sides of the adjacent tubes such that the partition defines two adjacent chambers with some of the exhaust tubes being in one of the chambers and others of the exhaust tubes being in the other of the chambers.

In the illustrated embodiment, each of the separate chambers is provided with a respective exhaust system comprised of an exhaust fan and control means therefor. Of course, a common exhaust fan could alternatively be provided and connected by way of a number of respective duct connections (not shown) to each of the separate chambers. Each duct connection would need control means, such as a control damper, so that communication with one or more of the chambers could be closed off as required.

We claim:

1. A spray booth comprising:

an enclosure in which material is sprayed;

an air inlet path in communication with said enclosure;

a substantially horizontally extending sub-floor arranged at the base of said enclosure and defining an air outlet chamber in communication with said enclosure;

partition means dividing said air outlet chamber into at least two separate chambers;

an air exhaust duct extending from said enclosure and in communication with each of said separate chambers;

means for supplying cleaning liquid to said sub-floor;

means for extracting air laden with the sprayed material from said enclosure through said separate chambers;

washing means in each of said separate chambers arranged such that said air laden with the sprayed material flows therethrough in intimate contact with said cleaning liquid; and means for independently controlling the volume of air flowing through each of said separate chambers.

2. A spray booth comprising:

an enclosure in which material is sprayed;

an air inlet path in communication with said enclosure;

a substantially horizontally extending sub-floor arranged at the base of said enclosure and defining an air outlet chamber in communication with said enclosure;

one or more substantially vertically extending partitions arranged to divide said air outlet chamber into two or more separate chambers each constituting a respective physically separate air outlet path, wherein said substantially vertically extending partitions project upwardly relative to said sub-floor and thereby divide the upper surface thereof into sections, each section being associated with said respective separate chambers;

means for extracting air laden with the sprayed material from said enclosure through said separate chambers;

respective washing means in each of said separate chambers arranged such that said air laden with the sprayed material flows therethrough in intimate contact with a cleaning liquid; and means for independently controlling the volume of air flowing through each said outlet path.

3. A spray booth as claimed in claim 2, wherein a respective air exhaust fan is associated with eachof said separate chambers and is arranged to discharge exhaust air into one or more outlet ducts and/or to atmosphere, and wherein control means, such as dampers, are associated with each said exhaust fan.

4. A spray booth as claimed in claim 2, wherein a common exhaust fan is provided and is communicated with each said separate chamber by way of a respective connecting duct, said common exhaust fan being arranged to discharge exhaust air into one or more outlet ducts and/or to atmosphere, and wherein control means, such as dampers, are associated with each said connecting duct.

5. A spray booth as claimed in claim 2, further comprising air supply means for supplying air to said air inlet path.

6. A spray booth as claimed in claim 5 wherein said air supply means is comprises of an air supply fan and a control damper arranged to control the volume of air supplied by said air supply fan.

7. A spray booth as claimed in claim 2, wherein each said washing means comprises one or more tubular members extending substantially vertically within the respective separate chamber and passing through said sub-floor, and further comprising means for supplying cleaning liquid arranged to supply the cleaning liquid onto said sub-floor such that said cleaning liquid passes through said tubular members in intimate contact with said material laden air.

8. A spray booth as claimed in claim 7 wherein said tubular members project relative to said sub-floor such that a pond for said cleaning liquid is defined on the upper surface of said sub-floor.

9. A spray booth as claimed in claim 7 wherein said sub-floor is spaced above a floor or plate and said tubular members are arranged such that the air and liquid flowing through said members impacts said floor or plate.

* * * * *